US009785086B2

(12) United States Patent
Maeshima et al.

(10) Patent No.: US 9,785,086 B2
(45) Date of Patent: Oct. 10, 2017

(54) DEVELOPER CONTAINER, DEVELOPING DEVICE, PROCESS CARTRIDGE, AND IMAGE FORMING APPARATUS

(71) Applicant: CANON KABUSHIKI KAISHA, Tokyo (JP)

(72) Inventors: Hideki Maeshima, Mishima (JP); Shuichi Gofuku, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/077,659

(22) Filed: Mar. 22, 2016

(65) Prior Publication Data

US 2016/0282763 A1 Sep. 29, 2016

(30) Foreign Application Priority Data

Mar. 27, 2015 (JP) ..... 2015-065555

(51) Int. Cl.
*G03G 15/08* (2006.01)

(52) U.S. Cl.
CPC . *G03G 15/0882* (2013.01); *G03G 2215/0132* (2013.01); *G03G 2215/0687* (2013.01)

(58) Field of Classification Search
CPC ..... G03G 15/0898; G03G 15/0881; G03G 15/0882; G03G 15/0886; G03G 15/0841; G03G 2215/0687; G03G 2215/0132
USPC ..... 399/106, 105
See application file for complete search history.

(56) References Cited

U.S. PATENT DOCUMENTS

2013/0308972 A1* 11/2013 Shindo ..... G03G 15/0882 399/106
2014/0072345 A1* 3/2014 Matsunaga ..... G03G 15/0841 399/258
2014/0079432 A1* 3/2014 Matsuzaki ..... G03G 15/0882 399/106
2014/0363196 A1* 12/2014 Wada ..... G03G 15/0898 399/106
2016/0062270 A1* 3/2016 Fukasawa ..... G03G 15/0882 399/106

FOREIGN PATENT DOCUMENTS

JP 5-197288 A 8/1993

* cited by examiner

*Primary Examiner* — Sophia S Chen
(74) *Attorney, Agent, or Firm* — Canon USA, Inc. I.P. Division

(57) ABSTRACT

A developing device including a developer container includes a containing chamber including an opening and configured to contain developer, a sealing member folded and configured to seal the opening, and an unsealing member to which one end of the sealing member is fixed. The containing chamber includes a first fixing portion and a second fixing portion that are fixed to the sealing member configured to seal the opening. A rotation center of the unsealing member is located at a position opposing an unsealing fulcrum of the unsealing member with respect to a virtual plane including the first fixing portion, the second fixing portion, and the opening when the sealing member is peeled from the containing chamber. Accordingly, a force required to peel the sealing member can be reduced.

19 Claims, 8 Drawing Sheets

Prior Art

DEVELOPER CONTAINER, DEVELOPING DEVICE, PROCESS CARTRIDGE, AND IMAGE FORMING APPARATUS

BACKGROUND OF THE INVENTION

Field of the Invention

The present invention relates to a developer container, a developing device, a process cartridge, and an image forming apparatus.

There is an image forming apparatus that forms an image on a recording material using an electrophotographic method. The image forming apparatus includes an electrophotographic copying machine. Alternatively, the image forming apparatus includes an electrophotographic printer such as a laser beam printer or a light emitting diode (LED) printer, a facsimile apparatus, and a word processor.

The process cartridge is a cartridge obtained by integrating a charging unit, a developing unit, or a cleaning unit and a photosensitive drum, and made removably mountable on a main body of an image forming apparatus.

Also, the process cartridge is a cartridge obtained by integrating at least one of a charging unit, a developing unit, and a cleaning unit and a photosensitive drum, and made removably mountable on a main body of an image forming apparatus. Further, the process cartridge is a cartridge obtained by integrating at least a developing unit and a photosensitive drum, and made removably mountable on a main body of an image forming apparatus.

The developing device is a device obtained by integrating a developing unit for developing an electrostatic latent image formed on a surface of a photosensitive drum, a developing frame body for supporting the developing unit, and a component associated with the developing unit, and made removably mountable on a main body of an image forming apparatus.

The developer container is a unit for containing developer used for an electrophotographic image forming process. The developer container contains the developer. The developer container includes a stirring conveyance unit for delivering the developer contained in the developer container.

Description of the Related Art

In an image forming apparatus using an electrophotographic image forming process, a cartridge type for making a cartridge such as a developing cartridge or a process cartridge removably mountable on a main body of the image forming apparatus has been used.

An example of a developing device of such a cartridge type is divided into a developing chamber including a developing roller and a supply roller for supplying developer to the developing roller and a containing chamber that contains the developer, and has an opening for communicating the developing chamber and the containing chamber with each other.

A sealing member seals the opening to close the containing chamber in the developing device until a user starts to use the cartridge. When the user uses the cartridge, the developer can be conveyed into the developing chamber from the containing chamber by peeling the sealing member from the opening. As a method for peeling the sealing member from the opening, various configurations have been proposed.

For example, Japanese Patent Application Laid-Open No. 5-197288 discusses sealing an opening for communicating a developing chamber and a containing chamber with each other using a sealing member and unsealing the sealing member using a rotary member provided in the containing chamber. The sealing member is unsealed by making its one end adhere to the rotary member. When the rotary member rotates, the sealing member is rewound and peeled from a peripheral edge of the opening. The sealing member rotates integrally with the rotary member after being unsealed.

However, in a comparative example illustrated in FIG. 8, to explain a method for peelably fixing one end portion 180*e* of a sealing member 180 to a peripheral edge of an opening 31*h* in a partition wall 31*i*, a fixing portion to an upper edge of the opening 31*h* in the partition wall 31*i* illustrated in FIG. 8 is a first fixing portion 31*j*. A fixing portion to a lower edge of the opening 31*h* in the partition wall 31*i* illustrated in FIG. 8 is a second fixing portion 31*k*.

When the sealing member 180 is peeled by the rotation in a direction indicated by an arrow H illustrated in FIG. 8 of a conveyance member 136, an unsealing fulcrum 136*g* of an unsealing member 136*e* is as follows. The unsealing fulcrum 136*g* of the unsealing member 136*e* when the sealing member 180 is peeled and a rotation center 136*h* of the unsealing member 136*e* are set on the same side with respect to a virtual plane E including the first fixing portion 31*j* and the second fixing portion 31*k*.

Thus, the sealing member 180 cannot be peeled along the virtual plane E parallel to a surface of the opening 31*h* formed in the partition wall 31*i* in a developing frame body 31, and needs to be peeled at a predetermined angle θ (>0) to the virtual plane E.

When the sealing member 180 is peeled at the predetermined angle θ (>0) to the virtual plane E parallel to the surface of the opening 31*h*, a large peeling force is required. Further, the sealing member 180 cannot be stably peeled from the peripheral edge of the opening 31*h*. Therefore, a surplus portion (e.g., remaining thread) of the sealing member 180 may occur.

As in the comparative example illustrated in FIG. 8, if a peeling force of the sealing member 180 is large when the sealing member 180 is peeled from the peripheral edge of the opening 31*h* in the partition wall 31*i*, a rotation load of the unsealing member 136*e* in the conveyance member 136 in the containing chamber 31*f* becomes large.

When the rotation load of the unsealing member 136*e* increases, a load on a motor provided in the main body of the image forming apparatus 100 that drives the conveyance member 136 to rotate increases. Accordingly, an output of the motor in the main body of the image forming apparatus 100 needs to be increased. Therefore, the size and the cost of the motor may be increased.

SUMMARY OF THE INVENTION

The present invention is directed to providing a developer container that reduces a force required to peel a sealing member.

According to an aspect of the present invention, a developer container includes a containing chamber including an opening and configured to contain developer, a sealing member folded and configured to seal the opening, and an unsealing member to which one end of the sealing member is fixed, wherein the containing chamber includes a first fixing portion and a second fixing portion that are fixed to the sealing member configured to seal the opening, and wherein a rotation center of the unsealing member is located at a position opposing an unsealing fulcrum of the unsealing member with respect to a virtual plane including the first fixing portion, the second fixing portion, and the opening, when the sealing member is peeled from the containing chamber.

Further features of the present invention will become apparent from the following description of exemplary embodiments with reference to the attached drawings.

DESCRIPTION OF THE EMBODIMENTS

An exemplary embodiment of an image forming apparatus in which a process cartridge including a developing device including a developer container according to the present invention is removably mounted will be specifically described with reference to the drawings.

<Image Forming Apparatus>

A configuration of an image forming apparatus 100 in which a process cartridge 70 including a developing unit serving as a developing device including a developer container 10 according to the present exemplary embodiment of the invention is removably mounted will be described with reference to FIG. 1. The image forming apparatus 100 according to the present exemplary embodiment is applied to an electrophotographic image forming apparatus that forms a color image using developer 200 (illustrated in FIG. 6) in four colors, i.e., yellow Y, magenta M, cyan C, and black K.

Figure 1:
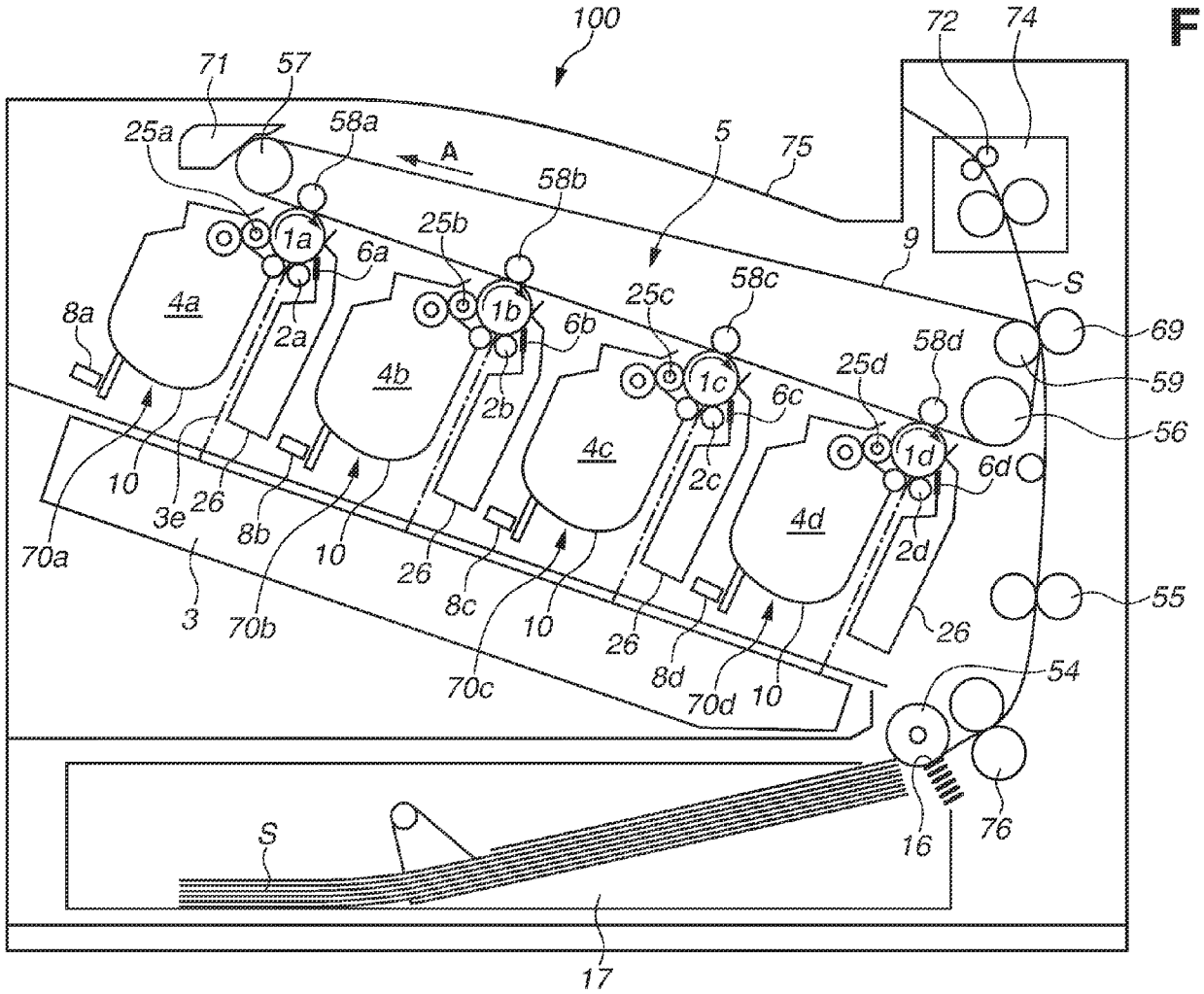
FIG. 1 is a cross-sectional view illustrating a configuration of an image forming apparatus in which a process cartridge including a developing device including a developer container according to the present invention is removably mounted.

As illustrated in FIG. 1, a mounting member (not illustrated) mounts process cartridges 70*a*, 70*b*, 70*c*, and 70*d* in four colors, i.e., yellow Y, magenta M, cyan C, and black K that are removably mounted in a main body of the image forming apparatus 100. For convenience of illustration, the process cartridge 70 may be merely used as a representative of the process cartridges 70*a*, 70*b*, 70*c*, and 70*d*. The same is true for other image forming process units.

An upstream side in a mounting direction of the process cartridge 70 toward the main body of the image forming apparatus 100 is a front surface side. A downstream side thereof in the mounting direction of the process cartridge 70 is a back surface side. In FIG. 1, a plurality of the process cartridges 70 is arranged along a predetermined angle of inclination to a horizontal direction in the main body of the image forming apparatus 100.

Each process cartridge 70 has a photosensitive drum 1 serving as an image bearing member rotatably provided therein. The image forming process units such as a charging roller 2 serving as a charging unit, a developing roller 25 serving as a developer bearing member, and a cleaning member 6 serving as a cleaning unit are integrally provided around each of the photosensitive drums 1.

A charging bias voltage is applied to the charging roller 2. Thus, a surface of the photosensitive drum 1 is uniformly charged. The developing roller 25 supplies a toner to an electrostatic latent image formed on the surface of the photosensitive drum 1 to develop it as a toner image into a visible image. After the toner image formed on the surface of the photosensitive drum 1 has been transferred onto a recording material S, the cleaning member 6 removes the toner remaining on the surface of the photosensitive drum 1.

A scanner unit 3 serving as an image exposure unit that scans and exposes a laser beam 3*e* corresponding to image information onto the surface of the photosensitive drum 1 is provided below the process cartridge 70 illustrated in FIG. 1. The laser beam 3*e* corresponding to the image information is scanned and exposed, from the scanner unit 3, onto the surface of the photosensitive drum 1 uniformly charged by the charging roller 2. Thus, an electrostatic latent image is formed on the surface of the photosensitive drum 1.

A feeding cassette 17 storing recording materials S is removably mounted in a lower part of the main body of the image forming apparatus 100. The recording materials S in the feeding cassette 17 are delivered by a feeding roller 54, and are separated one by one and fed in cooperation with a separation pad 16. Further, the recording material S is conveyed by a pair of conveyance rollers 76 toward a pair of registration rollers 55 that has been stopped once.

A leading edge of the recording material S nipped and conveyed by the pair of conveyance rollers 76 abuts on a nip portion of the pair of registration rollers 55 that has been stopped once. Further, when the recording material S is nipped and conveyed by the pair of conveyance rollers 76, skew of the leading edge of the recording material S is corrected along the nip portion of the pair of registration rollers 55, which has been stopped once, due to the stiffness of the recording material S.

The pair of registration rollers 55 conveys the recording material S to a secondary transfer nip portion between an outer peripheral surface of an intermediate transfer belt 9 and a secondary transfer roller 69 serving as a secondary transfer unit in synchronization with the electrostatic latent image formed on the surface of the photosensitive drum 1.

An intermediate transfer unit 5 for primarily transferring the toner image formed on the surface of each of the photosensitive drums 1 is provided above the process cartridge 70 illustrated in FIG. 1. The intermediate transfer unit 5 is provided with the intermediate transfer belt 9 stretched rotatably in a direction indicated by an arrow A illustrated in FIG. 1 by a driving roller 56, a driven roller 57, and an opposite roller 59 to oppose each of the photosensitive drums 1. The intermediate transfer belt 9 opposes each of the photosensitive drums 1, and circularly moves to contact the surface of the photosensitive drum 1.

Primary transfer rollers 58 serving as primary transfer units are respectively provided to oppose the photosensitive drums 1 on the side of an inner peripheral surface of the intermediate transfer belt 9. A primary transfer bias voltage is applied to each of the primary transfer rollers 58. Thus, toner images in the respective colors formed on the surfaces of the photosensitive drums 1 are sequentially primarily transferred and superimposed on the outer peripheral surface of the intermediate transfer belt 9.

The secondary transfer roller 69 serving as a secondary transfer unit is provided to oppose the opposite roller 59 via the intermediate transfer belt 9. A secondary transfer bias voltage is applied to the opposite roller 59 arranged on the side of the inner peripheral surface of the intermediate transfer belt 9 and the secondary transfer roller 69 at a timing when the recording material S nipped and conveyed by the pair of registration rollers 55 enters the secondary transfer nip portion. Thus, the toner images in the respective colors, which have been superimposed on the outer peripheral surface of the intermediate transfer belt 9, are secondarily transferred onto the recording material S.

Then, the recording material S nipped and conveyed by the secondary transfer roller 69 and the intermediate transfer belt 9 is conveyed to a fixing device 74 serving as a fixing unit. The recording material S is heated and pressurized while being nipped and conveyed by a pressure roller and a fixing roller provided in the fixing device 74 so that the toner image is heated and fixed on the recording material S. The fixing device 74 is arranged in an upper part of the main body of the image forming apparatus 100. Then, the recording material S is nipped by a pair of discharge rollers 72 and is discharged onto a discharge unit 75 provided above the main body of the image forming apparatus 100.

<Image Forming Operation>

An image forming operation for forming an image on the recording material S by the image forming apparatus 100 will be described with reference to FIG. 1. Each of the photosensitive drums 1 illustrated in FIG. 1 is rotated in a clockwise direction illustrated in FIG. 1. At the same time, the charging roller 2 uniformly charges the surface of each of the photosensitive drums 1. Then, the laser beam 3*e* corresponding to the image information is selectively scanned and exposed by being irradiated onto the surface of each of the photosensitive drums 1 uniformly charged. Thus, an electrostatic latent image corresponding to the image information is formed on the surface of the photosensitive drum 1.

The developing roller 25 supplies the toner to the electrostatic latent image to develop the toner as a toner image. Thus, the toner images in the respective colors are formed on the surfaces of the photosensitive drums 1. The pair of registration rollers 55 conveys the recording material S to the secondary transfer nip portion where the opposite roller 59 and the secondary transfer roller 69 abut on each other via the intermediate transfer belt 9 in synchronization with the image forming operation.

A secondary transfer bias voltage is applied to the secondary transfer roller 69. Thus, the toner images in the respective colors on the outer peripheral surface of the intermediate transfer belt 9 are secondarily transferred onto the recording material S. Accordingly, a color image is formed on the recording material S.

The fixing device 74 heats and pressurizes the recording material S, on which the color image has been formed, to fix the toner image. Then, the discharge roller 72 discharges the recording material S onto the discharge unit 75. The cleaning members 6 respectively scratch and collect the toners remaining on the surfaces of the photosensitive drums 1. A cleaning device 71 serving as a cleaning unit scratches and collects the toner remaining on the outer peripheral surface of the intermediate transfer belt 9.

<Process Cartridge>

Figure 2:
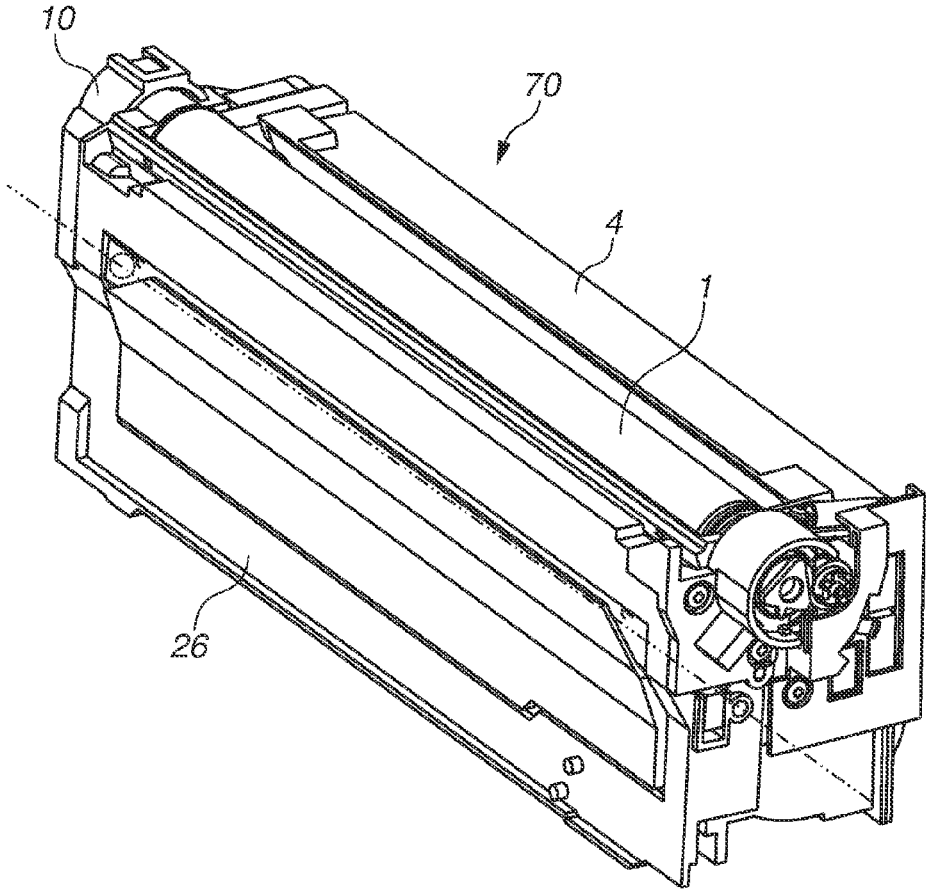
FIG. 2 is a perspective view illustrating a configuration of the process cartridge including the developing device including the developer container according to the present invention.
Figure 3:
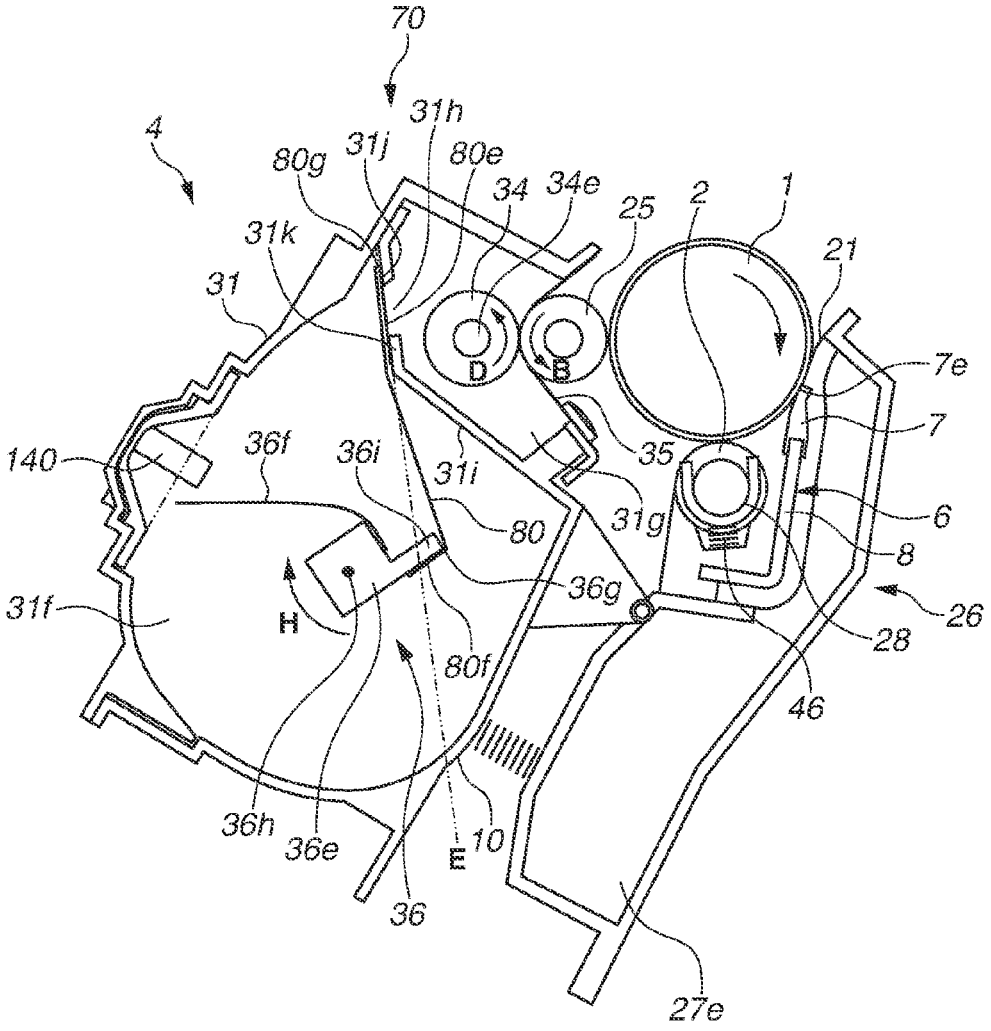
FIG. 3 is a cross-sectional view illustrating the configuration of the process device including the developer container according to the present invention.

A configuration of the process cartridge 70 will be described with reference to FIGS. 2 and 3. FIG. 2 is a perspective view illustrating a configuration of the process cartridge 70. FIG. 3 is a cross-sectional view illustrating a configuration of the process cartridge 70 in which the developer 200 is contained in a containing chamber 31*f* that contains the developer 200. FIG. 3 is a cross-sectional view as viewed from a plane perpendicular to an axis of the photosensitive drum 1 serving as the image bearing member. In the present exemplary embodiment, an axial direction of the photosensitive drum 1 is a longitudinal direction of the photosensitive drum 1. The axial direction of the photosensitive drum 1 is a longitudinal direction of the developer container 10.

In the present exemplary embodiment, the image forming apparatus 100 includes the process cartridge 70*a* that contains the toner of yellow Y. Further, the image forming apparatus 100 includes the process cartridge 70*b* that contains the toner of magenta M. Further, the image forming apparatus 100 includes the process cartridge 70*c* that contains the toner of cyan C. Further, the image forming apparatus 100 includes the process cartridge 70*d* that contains the toner of black K. The process cartridges 70*a*, 70*b*, 70*c*, and 70*d* respectively have substantially the same configurations except for the colors of the toners.

Each of the process cartridges 70*a*, 70*b*, 70*c*, and 70*d* includes a cleaning unit 26 and a developing unit 4 serving as a developing device. Each of the cleaning unit 26 includes the photosensitive drum 1, the charging roller 2, and the cleaning member 6 serving as a cleaning unit. Each of the developing units 4 includes the developer container 10, a conveyance member 36, a supply roller 34, and the developing roller 25.

The charging roller 2 and the cleaning member 6 are arranged on the outer periphery of each of the photosensitive drums 1. Each of the cleaning members 6 includes an elastic member 7 formed of a rubber blade and a support member 8 that supports the elastic member 7. A front end portion 7*e* of the elastic member 7 formed of the rubber blade abuts on the surface of the photosensitive drum 1 in a counter direction to a rotation direction (a clockwise direction illustrated in FIG. 3) of the photosensitive drum 1.

Each of the cleaning members 6 collects the residual toner, which has been scratched and removed from the top of the surface of the photosensitive drum 1, is collected by falling into a removed toner chamber 27*e*. A scooping sheet 21 for preventing the removed toner, which has been collected into the removed toner chamber 27*e*, from leaking abuts on the surface of the photosensitive drum 1.

A rotational driving force of a motor serving as a driving source (not illustrated) provided in the main body of the image forming apparatus 100 is transmitted to the cleaning unit 26. Thus, the photosensitive drum 1 is driven to rotate in response to the image forming operation. The charging roller 2 is rotatably pivoted on the cleaning unit 26 via a bearing 28.

The charging roller 2 is pressurized toward the surface of the photosensitive drum 1 by a pressure member 46 composed of a coil spring. Thus, the charging roller 2 rotates while being driven by the photosensitive drum 1.

<Conveyance Unit of Developer>

Figure 4:
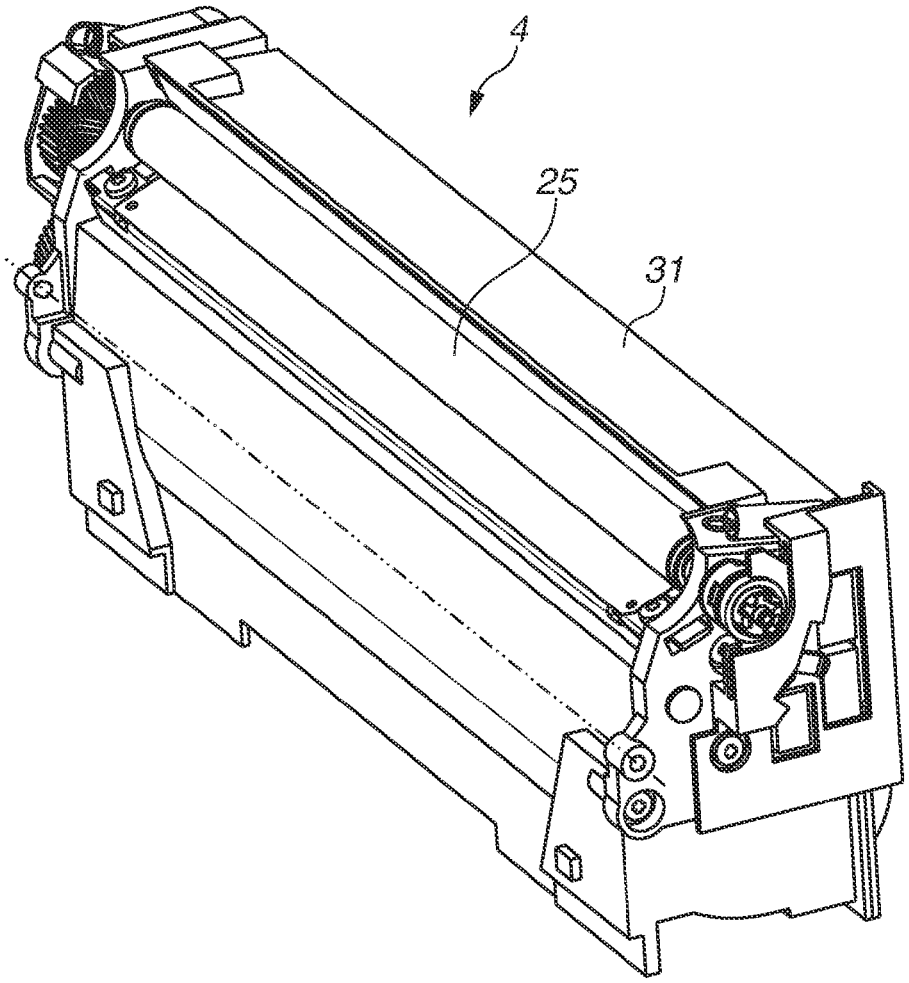
FIG. 4 is a perspective view illustrating a configuration of the developing device including the developer container according to the present invention.

As illustrated in FIGS. 2 and 3, the developing unit 4 serving as the developing device includes the developing roller 25 that rotates in a direction indicated by an arrow B illustrated in FIG. 3 in contact with the photosensitive drum 1 and the developing frame body 31 that rotatably supports the developing roller 25. The developing roller 25 rotatably supports the developing frame body 31 via a bearing attached to each of both sides of the developing frame body 31 illustrated in FIG. 4.

The supply roller 34, which rotates in a direction indicated by an arrow D illustrated in FIG. 3 in contact with the developing roller 25, and a developing blade 35 for regulating a layer of the developer 200 on the surface of the developing roller 25 are arranged on the outer periphery of the developing roller 25. A blowout prevention sheet, which abuts on the surface of the developing roller 25, is provided to prevent the developer 200 from leaking out of the developing frame body 31.

The conveyance member 36, which conveys the developer 200 in the containing chamber 31*f* formed by the developing frame body 31 constituting the developer container 10, is rotatably provided in the containing chamber 31*f*. When the conveyance member 36 rotates, the developer 200 contained in the containing chamber 31*f* is agitated.

Further, the developer 200 contained in the containing chamber 31*f* is conveyed into a developing chamber 31*g* via the opening 31*h* penetrating a partition wall 31*i* serving as a part of a wall surface of the containing chamber 31*f*. The supply roller 34 is rotatably provided in the developing chamber 31*g*.

The developing chamber 31*g* in the present exemplary embodiment is provided above the containing chamber 31*f*, and the developing roller 25 is provided above an unsealing member 36*e* serving as an axis of rotation of the conveyance member 36.

The conveyance member 36 provided in the containing chamber 31*f* conveys the developer 200 contained in the containing chamber 31*f* toward the supply roller 34 provided in the developing chamber 31*g*.

Figure 6:
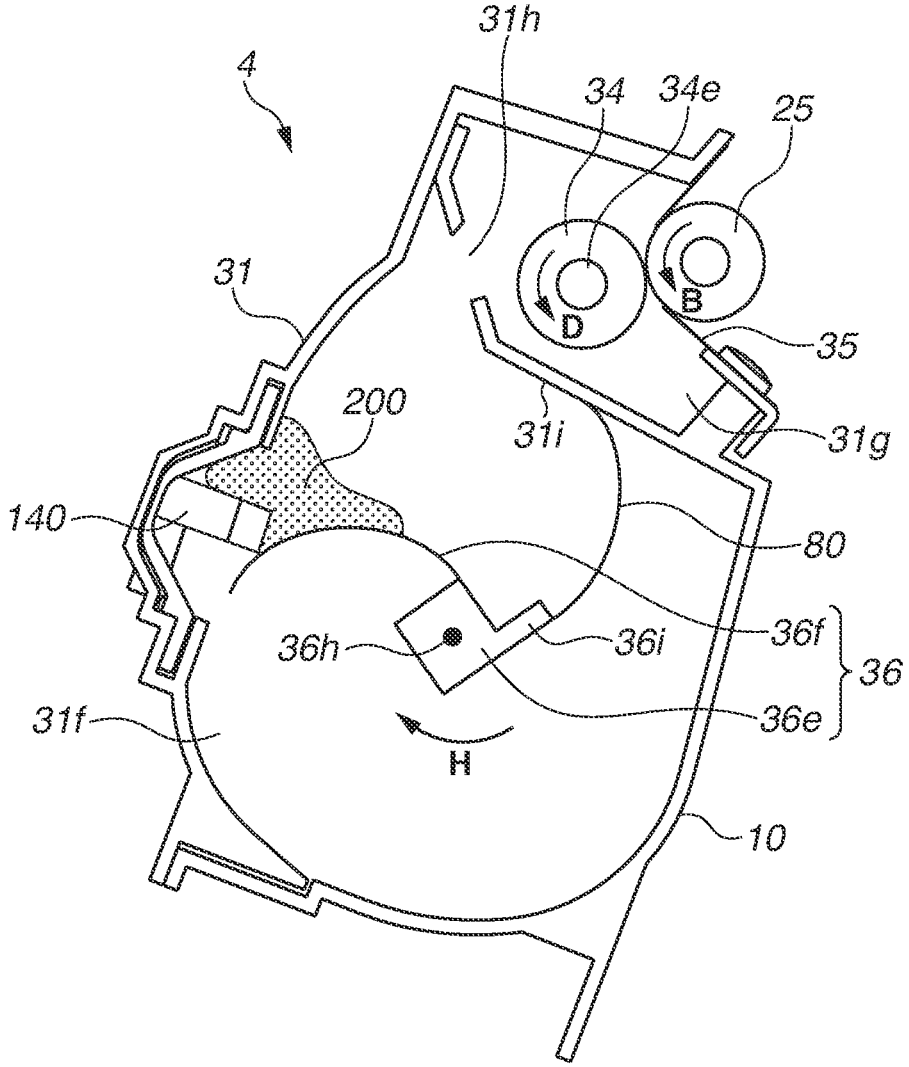
FIG. 6 is a cross-sectional view illustrating how a conveyance member provided in the developing device including the developer container according to the present invention conveys developer in a containing chamber.

As illustrated in FIG. 6, the conveyance member 36 includes the unsealing member 36*e* that is rotatable with the rotational driving force transmitted from the motor serving as the driving source (not illustrated) provided in the main body of the image forming apparatus 100. Further, the conveyance member 36 includes a sheet member 36*f* fixed to the unsealing member 36*e* to rotate integrally with the unsealing member 36*e*.

As illustrated in FIG. 3, the outer shape of the unsealing member 36*e* in the conveyance member 36 in the present exemplary embodiment is an L shape in cross section. An end portion 80*f* of a sealing member 80, which unsealably seals the opening 31*h* penetrating the partition wall 31*i* serving as a part of the wall surface of the containing chamber 31*f* is fixed, as illustrated in FIG. 5, to a projection portion 36*i* of the unsealing member 36*e*.

Figure 5:
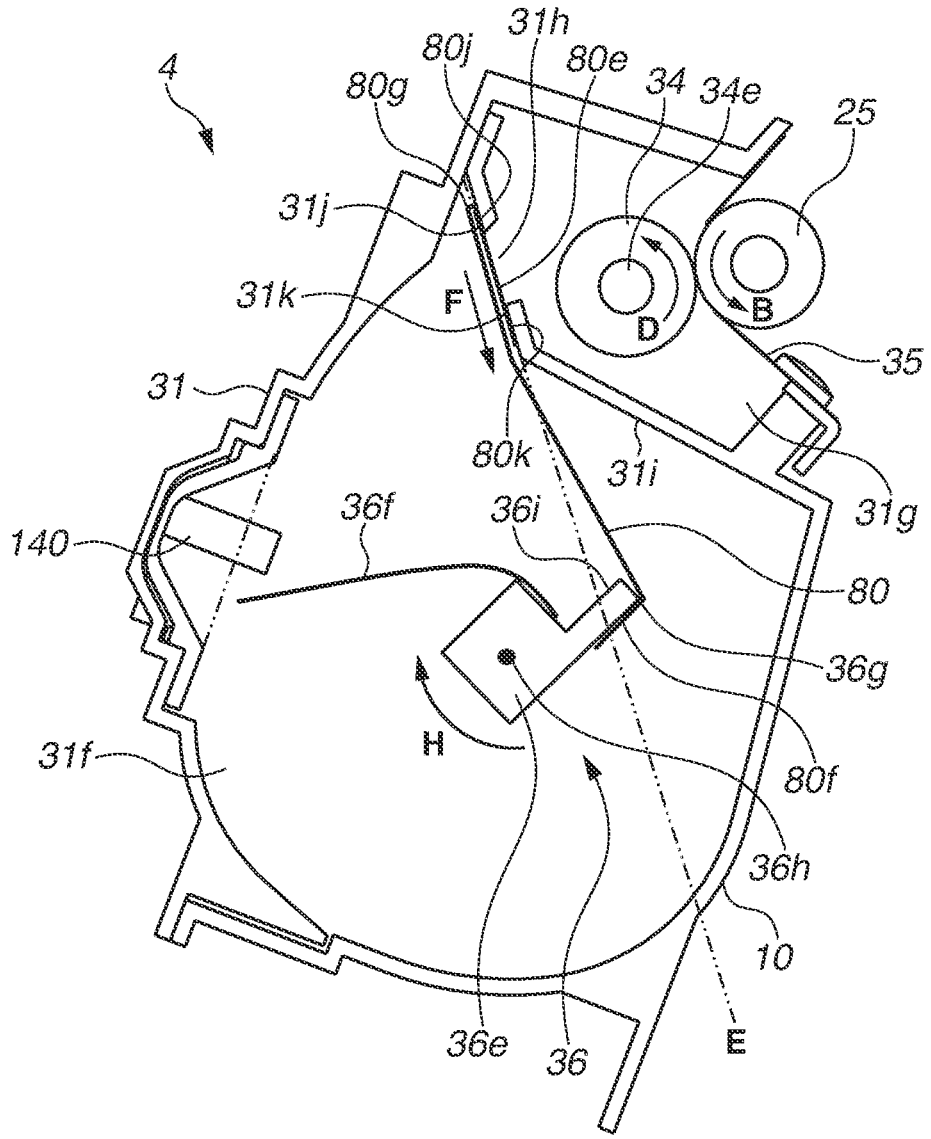
FIG. 5 is a cross-sectional view illustrating a state immediately before a sealing member provided in the developing device including the developer container according to the present invention is peeled from first and second fixing portions.

As illustrated in FIG. 5, a detection sensor 140, which detects the remaining amount of the developer 200 in the containing chamber 31*f*, is provided on an inner wall surface of the containing chamber 31*f*.

<Operation for Conveying Developer>

An operation for conveying the developer 200 in the developing unit 4 will be described with reference to FIGS. 6 and 7. As illustrated in FIG. 6, the conveyance member 36 rotates in a direction indicated by an arrow H illustrated in FIG. 6. Consequently, the developer 200 is pressed by the sheet member 36*f* to move in the containing chamber 31*f*.

Further, when the conveyance member 36 rotates in the direction indicated by the arrow H illustrated in FIG. 6, the sheet member 36*f* lifts the developer 200 in an upward direction illustrated in FIG. 6. As illustrated in FIG. 7, the developer 200 is conveyed to the supply roller 34 provided in the developing chamber 31*g* via the unsealed opening 31*h*.

Figure 7:
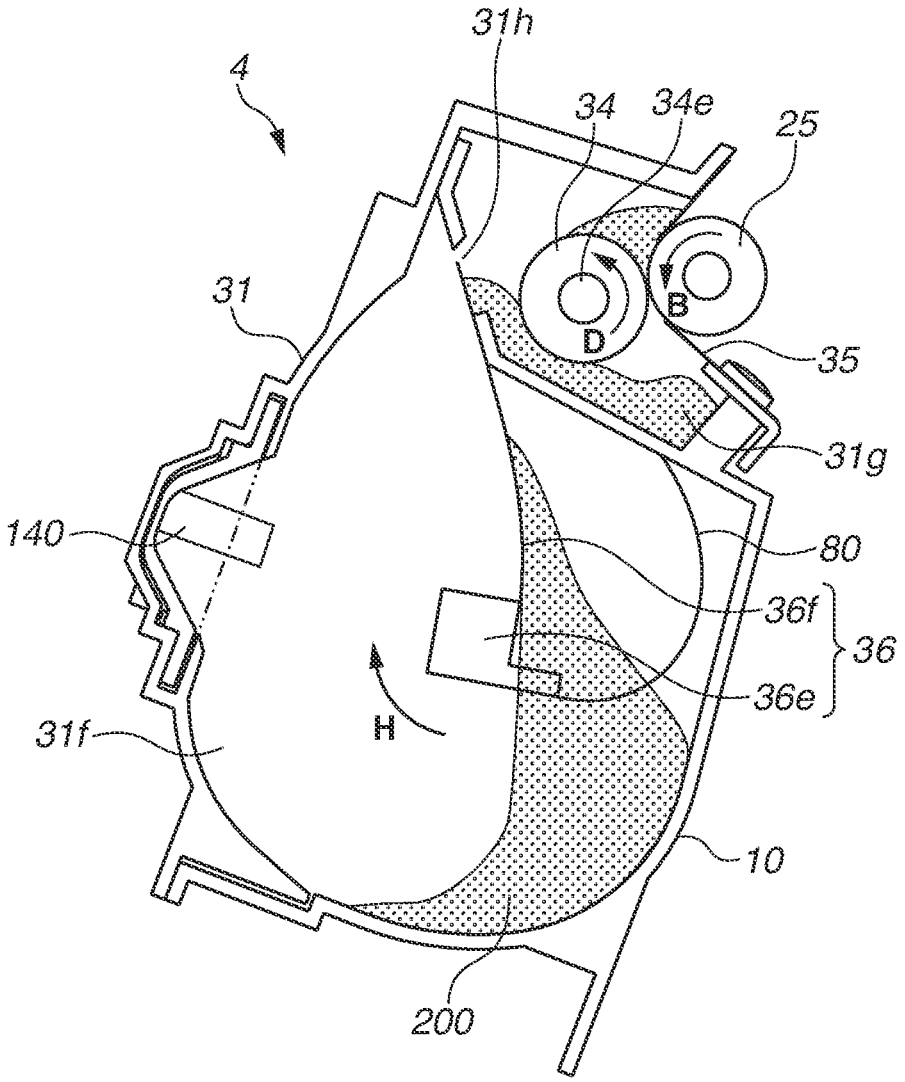
FIG. 7 is a cross-sectional view illustrating how the conveyance member provided in the developing device including the developer container according to the present invention conveys the developer in the containing chamber into a developing chamber via an opening.
Figure 8:
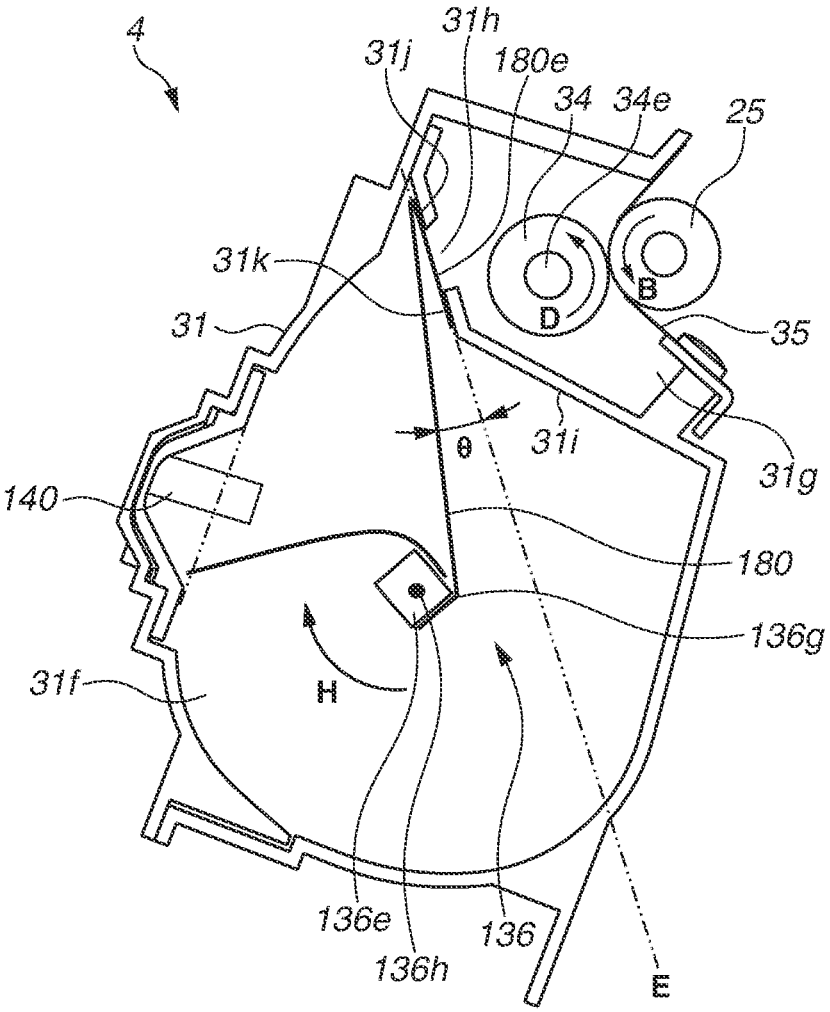
FIG. 8 is a cross-sectional view illustrating a state immediately before a sealing member provided in a developing device including a developer container in a comparative example is peeled from first and second fixing portions.

At the same time, a part of the developer 200 falls into the containing chamber 31*f* to accumulate in the bottom of the containing chamber 31*f*, and returns to the original state again, as illustrated in FIG. 7. When such a conveyance cycle is repeated, an operation for agitating and conveying the developer 200 in the containing chamber 31*f* is repeatedly performed.

The developer 200 supplied to the supply roller 34 in the developing chamber 31*g* is borne on the surface of the developing roller 25 by the rotation of the supply roller 34. Then, when a developing bias voltage is applied to the developing roller 25, the toner is supplied to the electrostatic latent image formed on the surface of the photosensitive drum 1, and the electrostatic latent image is developed as a toner image.

<Operation for Unsealing Sealing Member>

The developing unit 4 in the present exemplary embodiment is partitioned into the developing chamber 31*g* provided with the developing roller 25 and the supply roller 34 and the containing chamber 31*f* that contains the developer 200 with the partition wall 31*i*. The developing chamber 31*g* provided with the developing roller 25 serving as the developer bearing member and the containing chamber 31*f* are communicated with each other via the opening 31*h* penetrating the partition wall 31*i*. The developing roller serving as the developer bearing member bears the developer 200 that has been conveyed into the developing chamber 31*g* from the inside of the containing chamber 31*f* by the conveyance member 36.

In a period of time elapsed since the process cartridge 70 was produced in a factory until the user starts to use the process cartridge 70, the sealing member 80 seals the opening 31*h* to seal the developer 200 in the containing chamber 31*f*.

As illustrated in FIG. 5, one end portion 80*e* of the sealing member 80 is peelably fixed to a peripheral edge of the opening 31*h* formed in the partition wall 31*i* in the developing frame body 31 to seal the opening 31*h*. The other end portion 80*f* of the sealing member 80 is fixed to the projection portion 36*i* of the unsealing member 36*e* in the conveyance member 36.

As illustrated in FIG. 5, the sealing member 80 extending from the conveyance member 36 is peelably fixed to the peripheral edge of the opening 31*h* in the partition wall 31*i* by folding the one end portion 80*e* at a folding portion 80*g* to seal the opening 31*h*. The folding portion 80*g* at which the sealing member 80 in the present exemplary embodiment is folded is provided on the side of the containing chamber 31*f*.

The containing chamber 31*f* includes a first fixing portion 31*j* and a second fixing portion 31*k* that are fixed to the sealing member 80 for sealing the opening 31*h*. On the other hand, the sealing member 80 includes a first joined portion 80*j* joined to the first fixing portion 31*j* and a second joined portion 80*k* joined to the second fixing portion 31*k*. The first joined portion 80*j*, the second joined portion 80*k*, a third joined portion and a fourth joined portion, which are not illustrated, on the side of an end in a longitudinal direction of the opening 31*h* constitute a sealing portion that seals the opening 31*h*.

In the present exemplary embodiment, the first fixing portion 31*j* is arranged on the side of the folding portion 80*g* at which the sealing member 80 is folded, as illustrated in FIG. 5. The second fixing portion 31*k* is arranged on the side closer to an unsealing fulcrum 36*g* in the sealing member 80 than the first fixing portion 31*j*. The unsealing fulcrum 36*g* in the sealing member 80 is located at a leading end of the projection portion 36*i* of the unsealing member 36*e* in the conveyance member 36.

When the user uses the process cartridge 70, the conveyance member 36 in the containing chamber 31*f* rotates in a direction indicated by an arrow H illustrated in FIG. 5. Thus, the sealing member 80 is peeled from the peripheral edge of the opening 31*h* in the partition wall 31*i*. The peripheral edge of the opening 31*h* in the partition wall 31*i* to which the sealing member 80 is peelably fixed includes the first and second fixing portions 31*j* and 31*k*, illustrated in FIG. 5, and the third and fourth fixing portions (not illustrated) that connect the first and second fixing portions 31*j* and 31*k*.

The rotational driving force is transmitted from the motor serving as the driving source (not illustrated) so that the unsealing member 36*e* illustrated in FIG. 5 rotates in the direction indicated by the arrow H illustrated in FIG. 5. Thus, the sealing member 80 fixed to the projection portion 36*i* of the unsealing member 36*e* is pulled in an unsealing direction indicated by an arrow F illustrated in FIG. 5 so that the first fixing portion 31*j* and the first joined portion 80*j* are peeled from each other. Further, the third and fourth fixing portions and the third and fourth joined portions (not illustrated) on the side of the end in the longitudinal direction of the opening 31*h* are continuously peeled from each other. Furthermore, the second fixing portion 31*k* and the second joined portion 80*k* are continuously peeled from each other.

The sealing member 80 is thus peeled from the peripheral edge of the opening 31*h*. Thus, the sheet member 36*f*, which rotates in the direction indicated by the arrow H illustrated in FIG. 5 together with the unsealing member 36*e* when the opening 31*h* is unsealed, can convey the developer 200 to the developing chamber 31*g* from the containing chamber 31*f*.

The developing frame body 31 in the present exemplary embodiment and the partition wall 31*i* having the opening 31*h* formed therein are formed of a material that is not greatly deformed with a force for peeling the sealing member 80 so that the opening 31*h* does not change in position. For example, polystyrene resin can be used.

<Rotation Driving for Conveyance Member>

The conveyance member 36 is driven to rotate in the following manner. Gear connection from a gear (not illustrated) fixed to the rotating shaft 34*e* in the supply roller 34 to a gear (not illustrated) fixed to the unsealing member 36*e* in the conveyance member 36 is performed. The rotational driving force is transmitted from the motor serving as the driving source (not illustrated) provided in the main body of the image forming apparatus 100 is transmitted to the rotating shaft 34*e* in the supply roller 34.

<Fixing of Sealing Member>

To easily peel the one end portion 80*e* of the sealing member 80 from the peripheral edge of the opening 31*h* in the partition wall 31*i*, the one end portion 80*e* of the sealing member 80 is peelably fixed to the peripheral edge of the opening 31*h* in the partition wall 31*i* by folding the one end portion 80*e* at the folding portion 80*g* in the containing chamber 31*f*, as illustrated in FIG. 5.

As a method for peelably fixing the one end portion 80*e* of the sealing member 80 to the peripheral edge of the opening 31*h* in the partition wall 31*i*, a heat sealing method such as thermal welding is used in the present exemplary embodiment. In addition, a fixing method such as ultrasonic welding or a two-sided adhesive tape may be used.

A method for peelably fixing the one end portion 80*e* of the sealing member 80 to the peripheral edge of the opening 31*h* in the partition wall 31*i* will be described below with reference to FIG. 5. A fixing portion to an upper edge of the opening 31*h* in the partition wall 31*i*, illustrated in FIG. 5, is the first fixing portion 31*j*. A fixing portion to a lower edge of the opening 31*h* in the partition wall 31*i*, illustrated in FIG. 5, is the second fixing portion 31*k*.

The sealing member 80 fixed to the peripheral edge of the opening 31*h* in the partition wall 31*i* is peeled by the rotation in the direction indicated by the arrow H illustrated in FIG. 5 of the conveyance member 36. At this time, a rotation center 36*h* of the unsealing member 36*e* in the conveyance member 36 and the unsealing fulcrum 36*g* located at a leading edge of the projection portion 36*i* of the sealing member 80 fixed to the projection portion 36*i* of the unsealing member 36*e* in the conveyance member 36 are arranged as follows.

When the sealing member 80 is peeled from the containing chamber 31*f*, the rotation center 36*h* of the unsealing member 36*e* is as follows. The sealing member 80 is as follows with respect to a virtual plane E including the first fixing portion 31*j* fixed to the peripheral edge on the side of one end of the opening 31*h*, the second fixing portion 31*k* fixed to the peripheral edge on the side of the other end of the opening 31*h*, and the opening 31*h*. The sealing member 80 is set at a position opposing the unsealing fulcrum 36*g* of the unsealing member 36*e*.

Further, the rotation center 36*h* of the unsealing member 36*e* is located on the opposite side to the side of the unsealing fulcrum 36*g* of the unsealing member 36*e* with respect to the virtual plane E. The sealing member 80 is folded along the virtual plane E at the folding portion 80*g*. The first fixing portion 31*j* and the second fixing portion 31*k* are arranged on the same virtual plane E (on the virtual plane).

In a horizontal direction illustrated in FIG. 5 (a right-and-left direction illustrated in FIG. 5), the first fixing unit 31*j*, the second fixing unit 31*k*, and the unsealing fulcrum 36*g* of the unsealing member 36*e* are arranged in this order from the upstream side in the rotation direction indicated by the arrow H illustrated in FIG. 5 centered on the rotation center 36*h* of the unsealing member 36*e*.

In a vertical direction illustrated in FIG. 5 (an up-and-down direction illustrated in FIG. 5), the first fixing unit 31*j*, the second fixing unit 31*k*, and the unsealing fulcrum 36*g* of the unsealing member 36*e* are arranged in this order from above.

Thus, the sealing member 80 can be peeled along the virtual plane E parallel to a surface of the opening 31*h* formed in the partition wall 31*i* in the developing frame body 31. The sealing member 80 can be stably peeled from the peripheral edge of the opening 31*h* by being peeled along the virtual plane E parallel to the surface of the opening 31*h*. Its peeling force can be reduced. Thus, the occurrence of a surplus portion (e.g., remaining thread) of the sealing member 80 can be reduced.

According to the present exemplary embodiment, a peeling force for peeling the one end portion 80*e* of the sealing member 80 from the peripheral edge (the first and second fixing portions 31*j* and 31*k*) of the opening 31*h* in the partition wall 31 can be reduced. Thus, an output of the motor (not illustrated) provided in the main body of the image forming apparatus 100 can be reduced. Therefore, the size and the cost of the motor can be reduced. Accordingly, the image forming apparatus 100 can be miniaturized. The surplus portion of the sealing member 80 does not occur in the peripheral edge of the opening 31*h* (the first and second fixing portions 31*j* and 31*k*), so that a printed image of good quality can be provided to the user.

According to the present invention, a force required to peel the sealing member 80 can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-065555, filed Mar. 27, 2015, which is hereby incorporated by reference herein in its entirety.

What is claimed is:

1. A developer container comprising:

a chamber including an opening and configured to contain developer:

a sealing member configured to seal the opening; and an unsealing member to which one end of the sealing member is fixed and which has an unsealing fulcrum for assisting unsealing, wherein the chamber includes a first fixing portion and a second fixing portion that are fixed to the sealing member configured to seal the opening, wherein the second fixing portion is arranged closer to a rotation center of the unsealing member than the first fixing portion, wherein the sealing member is folded back before the sealing member is peeled, and wherein a rotation center of the unsealing member is located at a position opposing a leading end of the unsealing fulcrum of the unsealing member with respect to a virtual plane including the first fixing portion, the second fixing portion, and the opening, when the sealing member is peeled from the first fixing portion of the chamber and the unsealing fulcrum contacts the sealing member.

2. The developer container according to claim 1, wherein the rotation center of the unsealing member is located on the opposite side to the side of the leading end of the unsealing fulcrum with respect to the virtual plane.

3. The developer container according to claim 1, further comprising a folding portion at which the sealing member is folded.

4. The developer container according to claim 3, wherein the folding portion at which the sealing member is folded is provided on the side of the chamber.

5. The developer container according to claim 3, wherein the sealing member is folded along the virtual plane at the folding portion.

6. The developer container according to claim 1, wherein the first fixing portion is arranged on the side on which the sealing member is folded on the virtual plane, and wherein the second fixing portion is arranged on the side closer to the unsealing fulcrum than the first fixing portion on the virtual plane.

7. The developer container according to claim 6, wherein the first fixing portion, the second fixing portion, and the unsealing fulcrum of the unsealing member are arranged in this order from the upstream side in a rotation direction of the unsealing member in a horizontal direction.

8. The developer container according to claim 6, wherein the first fixing portion, the second fixing portion, and the unsealing fulcrum of the unsealing member are arranged in this order from above in a vertical direction.

9. The developer container according to claim 1, wherein an outer shape of the unsealing member is an L shape in cross section, and the unsealing fulcrum is located at a leading edge of a projection portion of the unsealing member.

10. The developer container according to claim 1, wherein the unsealing member serves as a conveyance member configured to convey the developer in the containing chamber.

11. A developing device comprising:

the developer container according to claim 1; and a developer bearing member configured to bear the developer conveyed by the unsealing member, wherein the opening communicates a developing chamber provided with the developer bearing member with the containing chamber.

12. The developing device according to claim 11, wherein the developer bearing member is provided above the unsealing member.

13. A process cartridge comprising the developer container according to claim 1.

14. An image forming apparatus comprising the developer container according to claim 1, wherein an image is formed using the developer.

15. The developer container according to claim 1, wherein an unsealing member has a projection portion and a leading edge of the projection portion is the unsealing fulcrum.

16. A developer container comprising:

a chamber including an opening and configured to contain developer:

a sealing member folded and configured to seal the opening; and an unsealing member to which one end of the sealing member is fixed and which has an unsealing fulcrum for assisting unsealing, wherein the chamber includes a first fixing portion and a second fixing portion that are fixed to the sealing member configured to seal the opening, wherein a rotation center of the unsealing member is located at a position opposing a leading end of the unsealing fulcrum of the unsealing member with respect to a virtual plane including the first fixing portion, the second fixing portion, and the opening, when the sealing member is peeled from the chamber, wherein an outer shape of the unsealing member is an L shape in cross section perpendicular to an axis of the unsealing member.

17. A developer container comprising:

a frame including an opening and configured to contain developer:

a sealing member configured to seal the opening; and an unsealing member to which one end of the sealing member is fixed and which has a projection portion, wherein the frame includes a first fixing portion and a second fixing portion that are fixed to the sealing member configured to seal the opening, wherein the second fixing portion is arranged closer to a rotation center of the unsealing member than the first fixing portion, wherein a rotation center of the unsealing member is located at a position opposing a leading edge of the projection portion with respect to a virtual plane including the first fixing portion, the second fixing portion, and the opening, when the sealing member is peeled from the frame and the leading edge contacts the sealing member.

18. The developer container according to claim 16, wherein the sealing member is folded back before the sealing member is peeled.

19. A developer container comprising:

a chamber including an opening and configured to contain developer:

a sealing member folded and configured to seal the opening; and an unsealing member to which one end of the sealing member is fixed and which has an unsealing fulcrum for assisting unsealing, wherein the chamber includes a first fixing portion and a second fixing portion that are fixed to the sealing member configured to seal the opening, wherein the second fixing portion is arranged closer to a rotation center of the unsealing member than the first fixing portion, and wherein the rotation center of the unsealing member is located at a position opposing a leading end of the unsealing fulcrum of the unsealing member with respect to a virtual plane including the first fixing portion, the second fixing portion, and the opening, when the sealing member is peeled from the first fixing portion of the chamber and the unsealing fulcrum contacts the sealing member.

* * * * *